US006095547A

United States Patent [19]

Vandergrift et al.

[11] Patent Number: 6,095,547

[45] Date of Patent: Aug. 1, 2000

[54] ACTIVE PIEZOELECTRIC DAMPER FOR A SNOW SKI OR SNOWBOARD

[75] Inventors: James A. Vandergrift; Anthony O. DeRocco, both of Seattle; Bard Glenne, Nordland; Shane M. K. Sterling, Seattle, all of Wash.

[73] Assignee: K-2 Corporation, Vashon, Wash.

[21] Appl. No.: 09/110,629

[22] Filed: Jul. 6, 1998

Related U.S. Application Data

[63] Continuation-in-part of application No. 08/509,970, Aug. 1, 1995, Pat. No. 5,775,715.

[51] Int. Cl.[7] ..... A63C 5/07

[52] U.S. Cl. ..... 280/602; 280/607; 280/610

[58] Field of Search ..... 280/602, 601, 280/607, 610, 809

[56] References Cited

U.S. PATENT DOCUMENTS

| | | |
|---|---|---|
| 2,258,046 | 10/1941 | Clement . |
| 2,539,224 | 1/1951 | Beerli . |
| 3,260,531 | 7/1966 | Heuvel . |
| 3,537,717 | 11/1970 | Caldwell . |
| 3,644,919 | 2/1972 | Mathauser . |
| 3,774,923 | 11/1973 | Suroff . |
| 3,894,437 | 7/1975 | Hagy et al. . |
| 4,288,088 | 9/1981 | Harrison . |

(List continued on next page.)

FOREIGN PATENT DOCUMENTS

| | | |
|---|---|---|
| 327754 | 2/1976 | Austria . |
| 376571 | 12/1984 | Austria . |
| 0 014 687 | 8/1980 | European Pat. Off. . |
| 0 207 302 | 1/1987 | European Pat. Off. . |
| 0490044A1 | 6/1992 | European Pat. Off. . |
| 0 700 698 A1 | 3/1996 | European Pat. Off. . |
| 1115843 | 4/1956 | France . |
| 2 503 569 | 10/1982 | France . |
| 2 504 809 | 11/1982 | France . |
| 2 575 393 | 7/1986 | France . |
| 2 643 430 | 8/1990 | France . |
| 2 693 379 | 1/1994 | France . |
| 2502031 A1 | 7/1976 | Germany . |
| 3315638A1 | 12/1983 | Germany . |
| 3505255A1 | 8/1986 | Germany . |
| 3919010A1 | 1/1990 | Germany . |
| 3933717A1 | 4/1990 | Germany . |
| 4020212A1 | 1/1991 | Germany . |
| 73456 | 4/1948 | Norway . |
| 465 603 | 10/1991 | Sweden ..... 280/602 |
| WO95/20827 | 8/1995 | WIPO . |
| WO 97/04841 | 2/1997 | WIPO . |

OTHER PUBLICATIONS

Article, "Smart skis and other adaptive structures," *961 Mechanical Engineering*, vol. 117, No. 11, (Nov. 1995) New York, NY.

Article, "ACX Gets Smart With Materials," *Boston Business Journal*, vol. 14, No. 30, Section 1, p. 3 (Sep. 9, 1994).

Article, "Leaping Into the Wind," *Los Angeles Times*, Home Edition, Business Section, p. 1, Pt. D, col. 2 (Jan. 3, 1995).

Article, "Miniature Motors for Future PC's; Personal Computers," *Mechanical Engineering–CIME*, vol. 117, No. 2, p. 63 (Feb. 1995).

*Primary Examiner*—Brian L. Johnson
*Assistant Examiner*—Bridget Avery
*Attorney, Agent, or Firm*—Christensen O'Connor; Johnson & Kindness PLLC

[57] ABSTRACT

A board, such as a ski or snowboard, that includes a piezoelectric damper. A sensor such as a piece of piezoelectric material is located on the body of the board such that, as the board vibrates or deforms, the piezoelectric sensor is also deformed. As the piezoelectric sensor deforms, it produces an electrical signal that is provided to a control circuit. The control circuit receives the electrical signal and generates a control signal of proportional amplitude and frequency, but an inverse waveform to the sensed vibration. The control signal causes a piezoelectric damper to stiffen and resist deformation of the board, thus damping the vibration. The sensed signal may also be stored within a memory device and subsequently downloaded to provide a skier profile for analysis.

19 Claims, 8 Drawing Sheets

U.S. PATENT DOCUMENTS 4,291,894 9/1981 D'Antonio et al. .
4,300,786 11/1981 Alley .
4,377,297 3/1983 Staufer .
4,383,702 5/1983 Salomon .
4,436,321 3/1984 Storandt et al. .
4,463,968 8/1984 Hull .
4,516,110 5/1985 Overmyer .
4,516,791 5/1985 Riss et al. .
4,526,397 7/1985 Richert .
4,545,598 10/1985 Spitaler et al. .
4,563,020 1/1986 Arieh et al. .
4,565,386 1/1986 Crainich .
4,565,940 1/1986 Hubbard, Jr. .
4,592,567 6/1986 Sartor .
4,626,730 12/1986 Hubbard, Jr. .
4,644,801 2/1987 Kustanovich .
4,647,061 3/1987 Girard .
4,696,487 9/1987 Girard .
4,697,820 10/1987 Hayashi et al. .
4,740,009 4/1988 Hoelzl .
4,804,200 2/1989 Kuchler .
4,834,407 5/1989 Salvo .
4,848,784 7/1989 Scherubl .
4,848,786 7/1989 Mankau .
4,892,325 1/1990 D'Antonio .
4,896,895 1/1990 Bettosini .
4,906,192 3/1990 Smithard et al. .
4,940,914 7/1990 Mizuno et al. .
4,980,597 12/1990 Iwao .
5,010,774 4/1991 Kikuo et al. .
5,049,079 9/1991 Furtado et al. .
5,051,605 9/1991 D'Antonio et al. .
5,079,949 1/1992 Tamori .
5,097,171 3/1992 Matsunaga et al. .
5,143,394 9/1992 Piana .
5,199,734 4/1993 Mayr .
5,270,607 12/1993 Terajima .
5,284,357 2/1994 Tinkler .
5,312,258 5/1994 Giorgio .
5,332,252 7/1994 Le Masson et al. .
5,332,253 7/1994 Couderc et al. .
5,332,254 7/1994 Juhasz .
5,333,889 8/1994 Piegay et al. .
5,342,077 8/1994 Abondance .
5,415,633 5/1995 Lazarus et al. .
5,590,908 1/1997 Carr ..... 280/809
5,775,715 7/1998 Vandergrift ..... 280/602
5,794,080 8/1998 Watanabe et al. ..... 396/53
5,806,875 9/1998 Bonvallet ..... 280/602
5,826,909 10/1998 Brommer et al. ..... 280/602
5,857,694 1/1999 Lazarus et al. ..... 280/602

10
12
12
12
12
12

ACTIVE PIEZOELECTRIC DAMPER FOR A SNOW SKI OR SNOWBOARD

CROSS REFERENCE TO RELATED APPLICATION

The present application is a continuation-in-part of copending U.S. patent application Ser. No. 08/509,970 filed Aug. 1, 1995, now U.S. Pat. No. 5,775,715.

FIELD OF THE INVENTION

The present invention relates to snow skis or snowboards and, more particularly, to snow skis or snowboards incorporating dampers to dampen out vibrations in the snow ski or snowboard.

BACKGROUND OF THE INVENTION

High performance snow skis are carefully designed in order to give the user maximum control during skiing. This includes designing skis to cleanly "carve" turns; that is, during the carving of a turn, every point on the edge of the ski is designed to pass over a single point on the snow. In order to accomplish this, skis are shaped with curved edges, such that the waist portion of the ski is narrower than the shovel or tail portions of the ski. In addition to the exterior shape of the ski, the structural core of the ski is carefully tailored such that the ski has the ability to smoothly flex over its length during the carving of a turn. The shape and structural core of snowboards are also designed to cleanly carve turns. Snowboards generally have curved edges and a waist portion that is narrower than the front or rear portions of the board.

During skiing or snowboarding, the ski or snowboard flexes continuously, both in response to irregularities in the snow and in response to the user's movements, such as during turning. In addition to flexing, skis and snowboards are subjected to vibrations caused by contact with the snow, irregularities in the snow, bumps or moguls, foreign objects, etc. These vibrations can cause the bottom and edges of a ski or snowboard to lose contact with the snow, affecting the ski's or snowboard's ability to cleanly carve turns. This loss of contact with the snow thus affects the skier's or snowboarder's ability to accurately control the path of the skis or snowboard, thus affecting overall performance.

In addition to affecting performance, vibrations within skis or snowboards cause noisy chattering that can be annoying or unsettling to the skier or snowboarder. Such vibrations can also travel into the bindings, boots and the user's legs resulting in discomfort.

Skis and snowboards vibrate in bending modes at particular resonant frequencies that can be predicted analytically or measured experimentally. The deformed shape of a ski or snowboard subject to a vibration differs, depending upon which resonant frequency the ski or snowboard is vibrating at. A ski or snowboard's resonant frequencies are a function of the length, width, thickness and stiffness of the ski or snowboard. Thus, the resonant frequencies are influenced by both the internal structure as well as the geometry of the ski or snowboard.

As illustrated in FIGS. 1A–E, an exemplary ski 10's deflected shape depends upon the resonant frequency at which the ski is vibrating. FIGS. 1B–E show the deformed shape of the central axis 12 of the ski 10 at four resonant frequencies. The resonant frequencies at which the ski vibrates during actual use depends upon both the geometric and structural characteristics of the ski and external conditions, including snow conditions and surface irregularities, such as whether the ski is being used on powder, hardpack, or on ice. Generally, the skis' first three resonant frequencies are most important, as they occur the most often and are most detrimental to the ski's ability to maintain controlled contact with the snow.

In addition to longitudinal flexural vibrations produced by beam bending as illustrated in FIGS. 1A–E, skis are also subject to torsional deflections and vibrations. Torsional vibrations affect a ski's performance in a similar manner as flexural vibrations, by affecting the contact between the bottom and edges of the ski and the snow.

Snowboards also vibrate due to longitudinal flexural vibrations during use. In a manner similar to that described above with respect to skis, snowboards vibrate at resonant frequencies that produce particular displacements or mode shapes. In addition, snowboards are also subject to torsional deflections and vibrations. Due to the greater width of a snowboard, torsional vibrations can produce a more pronounced effect on a snowboard's performance than torsional vibrations produced in snow skis.

The occurrence of and resulting effects on performance of both flexural and torsional vibrations in skis and snowboards is widely recognized in the industry. Reducing the effects of both longitudinal flexural and torsional vibrations has been and still is the subject of a great deal of research and development in the ski and snowboard industry. Prior proposed solutions include incorporating the use of viscoelastic or mechanical-type dampers into the structure of the skis or snowboards. U.S. Pat. Nos. 5,332,252 (Le Masson et al.) and 5,342,077 (Abondance) are two examples of patents disclosing skis or snowboards with vibration dampening or absorption devices. Unfortunately, none of the prior developments have been suitably effective in reducing or eliminating undesirable vibrations.

Most prior art ski vibration damping systems have incorporated viscoelastic damping devices. Such systems have tended to add significant weight to the ski and have been marginally effective. In addition, past ski vibration damping systems have been broad band dampers that do not discriminate with respect to the frequency or frequencies they dampen.

As can be seen from the above discussion, there exists a need for an improved system to reduce vibrations within skis and snowboards. The present invention is directed toward fulfilling this need.

SUMMARY OF THE INVENTION

A snowboard or ski according to the present invention includes a piezoelectric damper that is used to dampen vibrations within the ski or snowboard. The piezoelectric damper may be configured as either a passive or an active damper.

In one embodiment of a ski or snowboard according to the present invention, a board comprising a longitudinally extending structural but flexing body is provided. A piezoelectric material is coupled to the body so that it flexes as the body flexes. A control circuit is connected to the piezoelectric material and provides a control signal to the piezoelectric material that causes it to dampen flexing of the body.

In accordance with other aspects in the invention, the control circuit and piezoelectric material are configured to act as either an active damper or a passive damper. The piezoelectric material may be oriented either longitudinally along the axis of the body or obliquely to the axis of the body to dampen either longitudinal flexural or torsional vibrations.

In accordance with other aspects of the invention, the layer of piezoelectric material is positioned near to the top surface of the body. The layer of piezoelectric material may also be preferably positioned beneath, forward or aft of a ski binding or between the forward and aft bindings mounted on the body of a snowboard.

In accordance with still further aspects of the invention, the control circuit may include adjustments which allow a user to select the amount of damping produced by the piezoelectric damper. The control circuit and piezoelectric material may also be configured to provide broad band damping or to provide damping at selected frequencies.

The present invention produces a number of advantages over prior art damping systems. The present invention is an effective damper of both torsional and flexural vibrations depending upon the configuration it is used in. In addition, some embodiments of the present invention can allow users to select the amount of damping produced. The present invention also allows damping at only undesirable vibration frequencies by tailoring the design of the control circuit. Use of the present invention can reduce or eliminate the problems associated with vibrations in skis and snowboards. This reduction in undesirable vibrations can increase a skier's or snowboarder's control and decrease undesirable ski and snowboard chattering.

In a further aspect of the present invention, a ski or snowboard includes an active piezoelectric damper system. The damper system includes a sensor for sensing the frequency of vibration of a portion of the ski or snowboard body. The damper system also includes a power supply, a control circuit and a piezoelectric damper. The control circuit generates a control signal that is proportional to and an inverse waveform of the sensed vibration. The control signal is supplied to a piezoelectric damper, also mounted within the snowboard or ski, which deforms or stiffens in an alternating cyclic fashion to reduce or cancel out the vibrational frequency.

BRIEF DESCRIPTION OF THE DRAWINGS

The foregoing aspects and many of the attendant advantages of this invention will be more readily appreciated as the same become better understood by reference to the following detailed description, when taken in conjunction with the accompanying drawings, wherein.

DETAILED DESCRIPTION OF THE PREFERRED EMBODIMENT

As discussed heretofore, FIGS. 1A–E illustrate a ski 10 in its undeformed state and in its deformed state when vibrating at its first four resonant vibration frequencies. FIGS. 1A–E are for illustrative purposes only and are not to scale. As illustrated in FIGS. 1B–E, the ski 10 deflects as a result of the resonant vibrations. Although the ski 10 deflects over its entire length, the most prominent deflections are observed in the forward two-thirds of the ski. The magnitude of the deflections are sufficient to affect control and cause discomfort to the skier under some conditions. One method of reducing the problems associated with resonant vibrations is to somehow dampen the magnitude of the vibrations thus reducing their effects. The present invention is a piezoelectric damping system for use on either snow skis or snowboards to dampen undesirable vibrations.

Figures 1A, 1B, 1C, 1D, 1E:
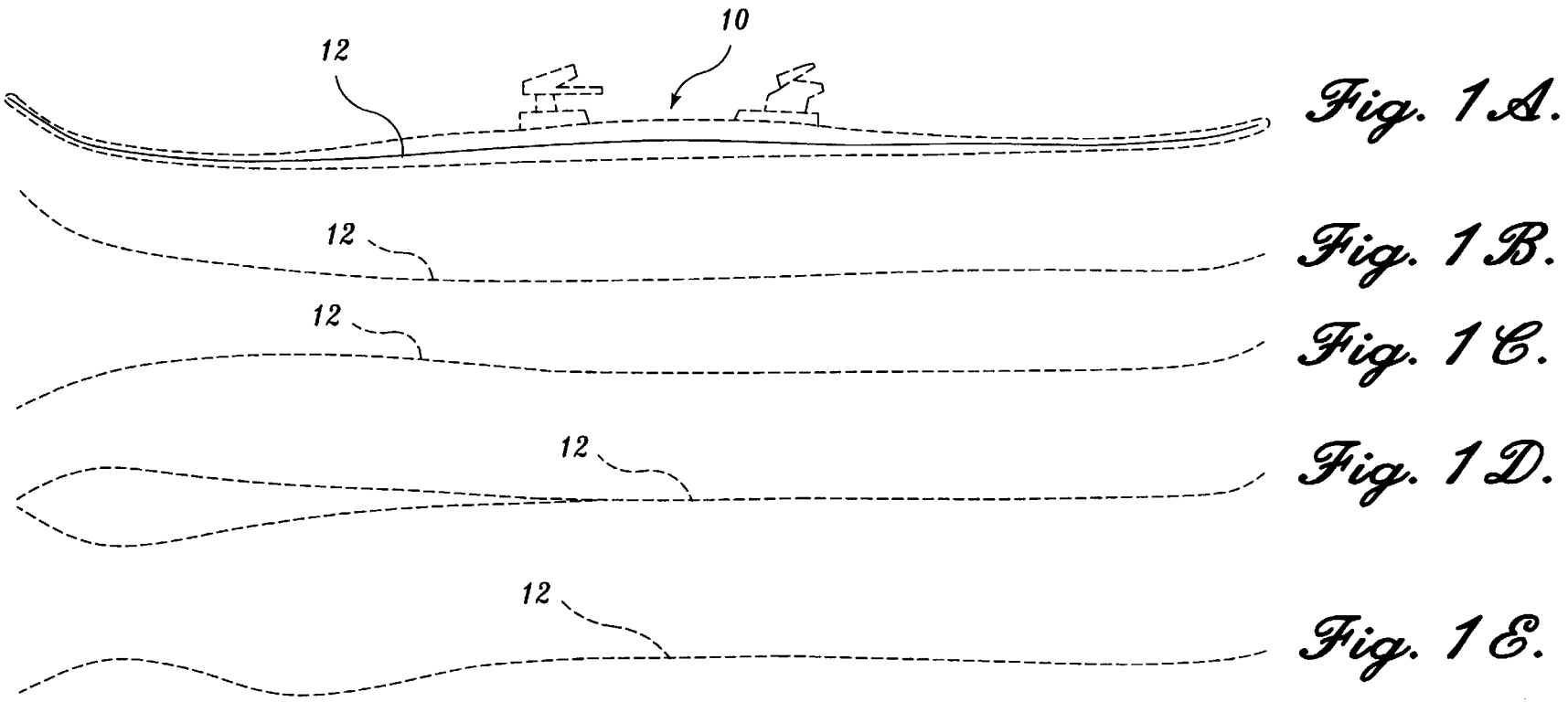
FIGS. 1A–E are schematic illustrations of four different resonant vibration modes of an exemplary ski.
Figure 2:
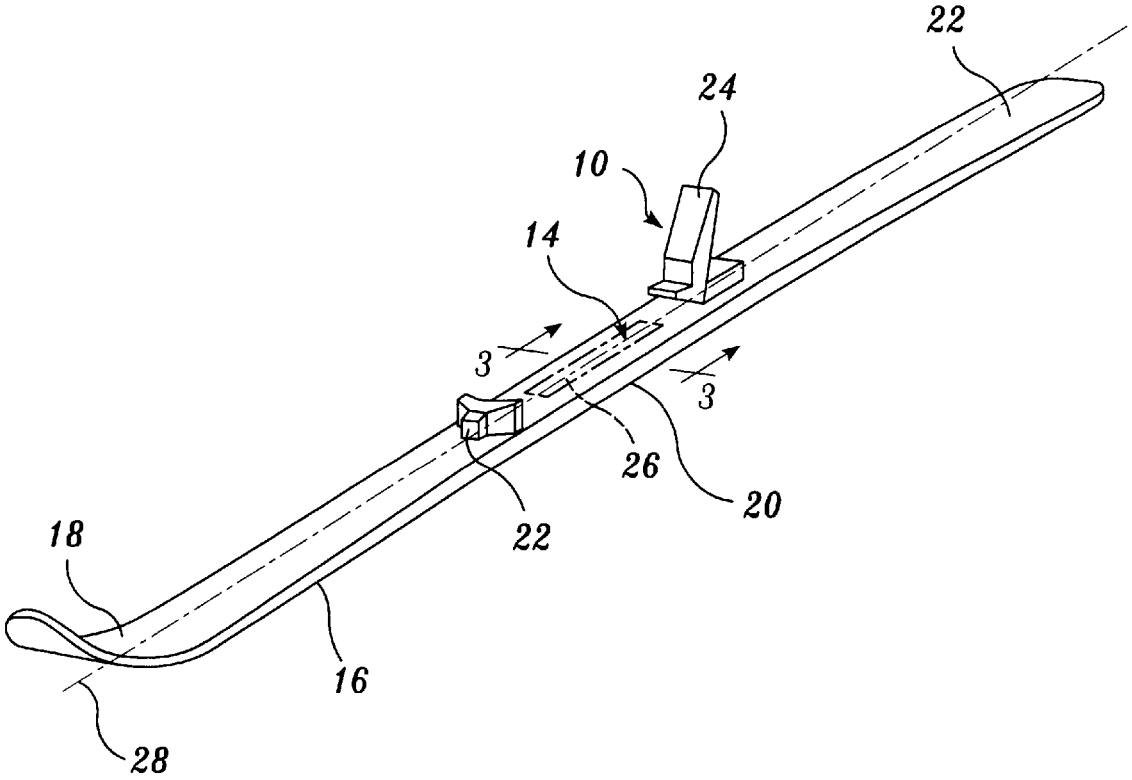
FIG. 2 is a perspective view of a ski including a piezoelectric damping system in accordance with the present invention.

FIG. 2 illustrates a first embodiment of a snow ski 10 including a piezoelectric damping system 14 according to the present invention. The piezoelectric damping system 14 is used to dampen vibrations within the ski when it is being used. Although the piezoelectric damping system is described below with respect to a particular type of ski, alternate embodiments of the invention may be used with different types of skis or snowboards.

The body 16 of the ski 10 is an elongate beam type member that includes a forward upturned shovel portion 18 which prevents the front of the ski from digging into the snow as it moves over the surface of the snow. The body 16 narrows as it progresses longitudinally rearward from the shovel portion 18 along its length until it reaches a narrowed waist portion 20, at which point the body extends longitudinally rearward and widens into a tail portion 22. As described in the Background of the Invention, the narrowing and widening exterior shape of the ski helps the ski carve a proper turn around a single point in the snow during use.

Toe and heel ski bindings 22 and 24, respectively, are mounted in the narrowed waist portion 20 through the use of fasteners or other means, as is commonly known in the art. The toe and heel bindings 22 and 24 shown are for illustrative purposes only and may be of a number of different configurations that accept and releasably hold a user's ski boot (not shown).

In the first embodiment illustrated in FIG. 2, the piezoelectric damping system 14 is located in the narrowed waist portion 20 and extends longitudinally part of the way between the toe and heel bindings 22 and 24. The damping system 14 includes a piezoelectric damper 26 (FIGS. 3 and 4) formed of one or more layers of piezoelectric material 70 and a control circuit 32, as described in detail below.

Figure 8:
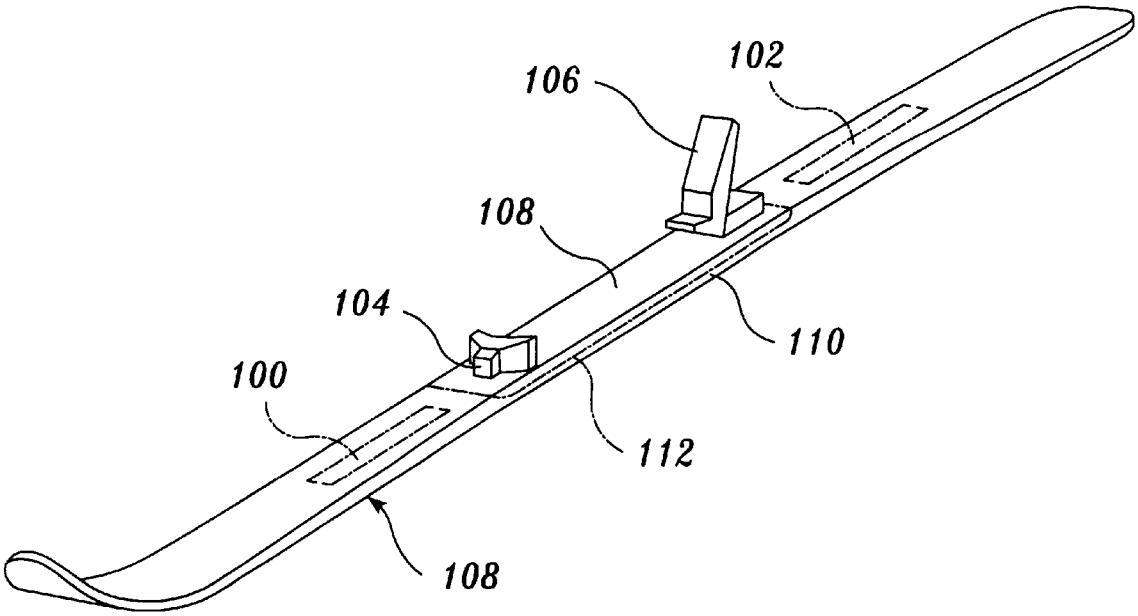
FIG. 8 is a third embodiment of a ski, including a piezoelectric damper, according to the present invention.

As described below with respect to additional embodiments of the invention, the piezoelectric damping system 14 may also be located in front of the toe binding 22, behind the heel binding 24 (FIG. 6), or in more than one location over the length of the ski 10 (FIG. 8). Also as described below, the piezoelectric damping system 14 may extend longitudinally along the length of the ski or may extend perpendicularly across the width of the ski or obliquely between the sides of the ski depending upon the application.

Figure 3:
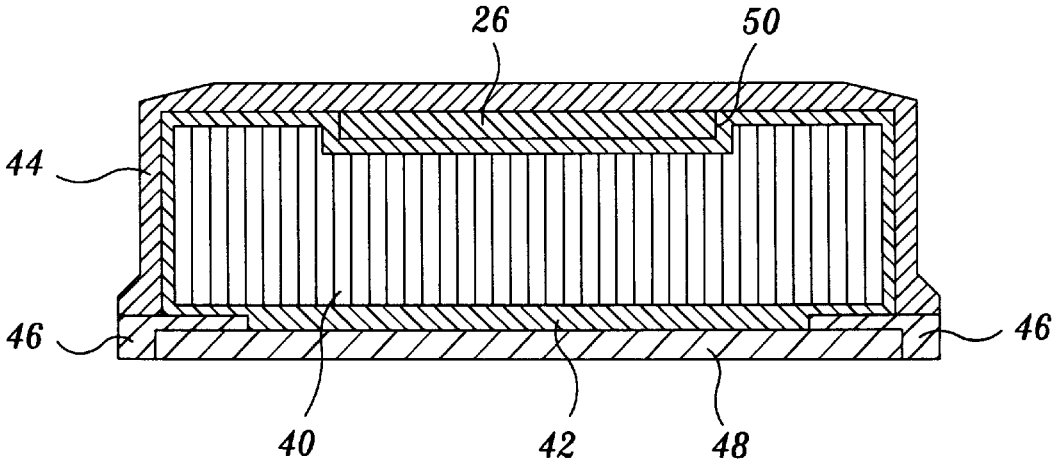
FIG. 3 is a cross section of the ski of FIG. 2 taken at line 3—3 in FIG. 2.

As illustrated in FIG. 3, in the first embodiment, the body of the ski comprises a structural but flexing core 40, which is shaped to form the shovel portion 18, narrowed raised portion 20, and tail portion 22. The core 40 can be formed of a number of different suitable materials commonly used in ski fabrication, including wood, a honeycomb metal structure, structural foam, etc. In order to stiffen and strengthen the core 40, it is desirable to wrap the core with a fiber-reinforced layer 42. The fiber reinforced layer 42 forms a structural torsion box surrounding the core 40. The fiber reinforced layer can include a triaxially braided composite structure, as described in U.S. Pat. No. 4,690,850 (Fezio), a fiber reinforced cloth, a filament wound structure, layers of unidirectional fiber reinforced prepreg, or other suitable reinforcement materials.

A number of high modulus fibrous materials can be used to form the reinforced layer 42, including fiberglass, graphite fibers, organic fibers such as Kevlar®, metal wire, and polyester, to name a few. The reinforced layer 42 may be formed of a fibrous material that has been preimpregnated with a matrix system, or may be formed of dry fibers which are later impregnated with a matrix system. Possible matrix systems including epoxy resins, other adhesive systems, thermoplastic matrix systems, or other suitable high-strength, flexible materials.

The number of layers of material, fiber orientations in each layer, and thickness of each material used to reinforce the core 40 are carefully determined in a manner well known in the art to ensure that the finished ski 10 will have the proper structural bending and torsional characteristics. This includes designing the ski 10 such that it can withstand the structural loads in the application and can properly flex in order to give the ski the ability to cleanly carve turns.

In order to protect the core 40 and reinforced layer 42, and to cosmetically enhance the appearance of the ski, a protective cap 44 may be placed around the vertical side surfaces and top layer of the core and reinforced layer. In the first embodiment, the cap 44 is formed as a single piece of a durable protective material. Any suitable material that can withstand the harsh temperature environment, large deflections, and punishments experienced by a ski may be used, such as a variety of different plastics or resins.

In alternate embodiments of the invention, the internal structure of the ski 10 may differ from the first embodiment illustrated. Numerous different ski designs and structures are commonly known in the art and could be used along with the invention. For example, in place of a one-piece cap 44, some skis use separate protective sidewalls joined to a decorative and protective top layer.

In order to achieve high performance and durability, the lower edges 46 of the ski must be able to cut into the snow and ice to allow the skier to carve a proper turn. Therefore, it is desirable that the lower edges 46 of the ski be formed of a stiff, durable material which can achieve this goal. In the preferred embodiment, two L-shaped steel lower edges 46 are placed at the lower corners of the ski. The edges 46 extend longitudinally along the entire length of the ski 10 and can be formed of any materials that create a durable, sharp edge capable of cutting into snow nd ice. The cutting edges 46 are typically formed of steel alloys capable of holding sharp cutting edge.

To increase the performance of the ski, a smooth, slick, low-friction running surface 48 is placed upon the lower surface of the core assembly. The running surface can be formed of any appropriate material which creates a smooth, friction-free running surface that allows the ski to move freely over snow and ice. In the preferred embodiment, a sintered polyethylene is used to form the running surface, however, other plastics, Teflon®, or polymer-based materials could be used.

According to the present invention, the body 16 of the ski 10 includes the damping system 14 (FIG. 2) located between the toe and heel bindings 22 and 24. In the first embodiment, a piezoelectric damper 26 is located within the interior of the ski beneath the protective cap 44 (FIG. 3). As illustrated in FIG. 3, the piezoelectric damper 26 is located within a recess 50 formed in the upper surface of the core 40 and reinforced layer 42.

The recess 50 is formed in upper surface of the core 40 during its fabrication. As the reinforced layer 42 is placed over the upper surface of the core 40, it is depressed downward into the recess in the upper surface of the core, thus forming the recess 50. The width and length of the recess 50 is sized to receive the piezoelectric damper 26.

The damping system 14 is used to dampen vibrations within the body of the ski 10. As discussed in the specification, several different damping systems have been used on skis in the prior art. However, none of the systems have been completely successful.

In the present invention, a piezoelectric damper 26 is used to dampen vibrations within the body of the ski. The piezoelectric damper 26 dampens vibrations by increasing the local stiffness of the ski in the region of the piezoelectric damper when the ski flexes or vibrates. In order to achieve the most beneficial results, it is important that the deformation or strain energy within the body of the ski be passed to the piezoelectric damper. This allows the piezoelectric damper to produce the greatest degree of damping.

In order to transfer the greatest amount of strain energy into a piezoelectric damper, it is advantageous that the piezoelectric damper be placed in an area of high deformation during the ski's vibration. It is also important that the piezoelectric damper be mounted to the body of the ski in such a way as to pass strain energy into the structure of the piezoelectric damper.

In the preferred embodiment, the piezoelectric damper is mounted on the torsion box formed of the fiber reinforced layer 42 surrounding the core 40. The torsion box is the primary load carrying structural member of the ski, and thus the member carrying the greatest amount of strain energy. Therefore, it is advantageous to place the piezoelectric damper directly on the torsion box, and the preferred embodiment directly on the reinforced layer 42.

It is also important that the piezoelectric damper 26 be mounted to the reinforced layer 42 in a manner to allow the greatest amount of strain energy to pass from the reinforced layer into the structure of the piezoelectric damper. Mounting the piezoelectric damper 26 within the recess 50 allows the piezoelectric damper to be placed on top of the reinforced layer 42 without altering the smooth upper surface of the ski. In addition, recessing the piezoelectric damper 26 within the reinforced layer 42, as shown, helps to provide an efficient load path to transfer strain energy from the reinforced layer into the piezoelectric damper.

In other embodiments of the invention, it can be advantageous to mount a load intensifier on the top of the reinforced layer 42. The piezoelectric damper 26 may be mounted upon the surface of the load intensifier in order to increase the amount of strain energy passed to the piezoelectric damper. One method to produce a load intensifier is to adhesively bond an aluminum plate (not shown) to the top of the reinforced layer 42 in the region where the damper is located. Aluminum generally has a slightly higher stiffness than materials commonly used to form the reinforced layer 42. The greater stiffness of the aluminum load intensifier results in the load intensifier carrying the majority of the structural load or strain energy within the region of the load intensifier. Thus, adhesively bonding or otherwise mounting the piezoelectric damper 26 on the aluminum load intensifier allows a greater percentage of the strain energy within the ski to be passed to the piezoelectric damper during vibration of the ski. In alternate embodiments, load intensifiers formed of other materials could also be used.

In the first embodiment, the piezoelectric damper 26 is formed as a planar member that extends from the central axis 28 (FIG. 2) of the ski outward approximately halfway to both edges of the ski. The piezoelectric damper 26 also extends from a point spaced slightly rearward of the rear edge of the toe binding 22 longitudinally to a point spaced slightly forward of the forward edge of the heel binding 24. As will be better understood by the discussion below, the length, width and thickness of the piezoelectric damper 26 may be altered in order to fit it to the dimensions of the ski and to increase or decrease the magnitude of damping provided.

Some ceramic materials and some inorganic crystals, such as quartz and barium titanate, have been known to exhibit piezoelectric characteristics. Piezoelectric materials transform a mechanical force to an electrical potential, or an electrical potential to a mechanical response. Applying an electrical signal to a piezoelectric material can change the width or length of the piezoelectric material, depending upon its orientation. If an alternating electrical signal is applied to a piezoelectric material, the material can be made to expand and contract at a controlled rate. Conversely, when a piezoelectric material undergoes mechanical deformations or vibrations, the piezoelectric material produces an electrical potential.

In addition to inorganic crystals, such as quartz and barium titanate, some organic polymers, such as polyvinylidene fluoride ($PVF_2$), polyvinyl fluoride and polyvinyl chloride also exhibit some piezoelectric properties when properly treated. In many applications, organic polymer piezoelectric materials and inorganic crystal piezoelectric materials may be used interchangeably. In other applications, piezoelectric organic polymers are advantageous because they may be more easily formed into thin films or other shapes. Organic polymer piezoelectric films can also be fabricated so that they are both flexible and lightweight. Organic polymer piezoelectric films are generally polarized so that they have a positive surface and a negative surface. Applying a positive potential to the positive surface of such a piezoelectric film causes the film to elongate, while conversely applying a negative potential to the positive surface of such a piezoelectric film causes the film to contract. The mechanical deflections produced in the piezoelectric materials may be increased by bonding one or more layers or films together to form a bimorph in a manner well known in the art.

In the present invention, the piezoelectric damper 26 may be formed of either ceramic, inorganic crystal, or organic polymer piezoelectric materials. However, in the first embodiment it is advantageous to form the piezoelectric damper from ceramic barium or lead zirconate titanate due to the ceramic's greater stiffness and piezoelectric properties. Lead zirconate titanate ceramic piezoelectric materials generally have a stiffness similar to that of aluminum, which in turn is generally similar to the stiffness of the body of a ski. In other applications, it may be advantageous to form the piezoelectric damper from organic polymers due to their ability to be easily formed into thin films or particular shapes.

Figure 4:
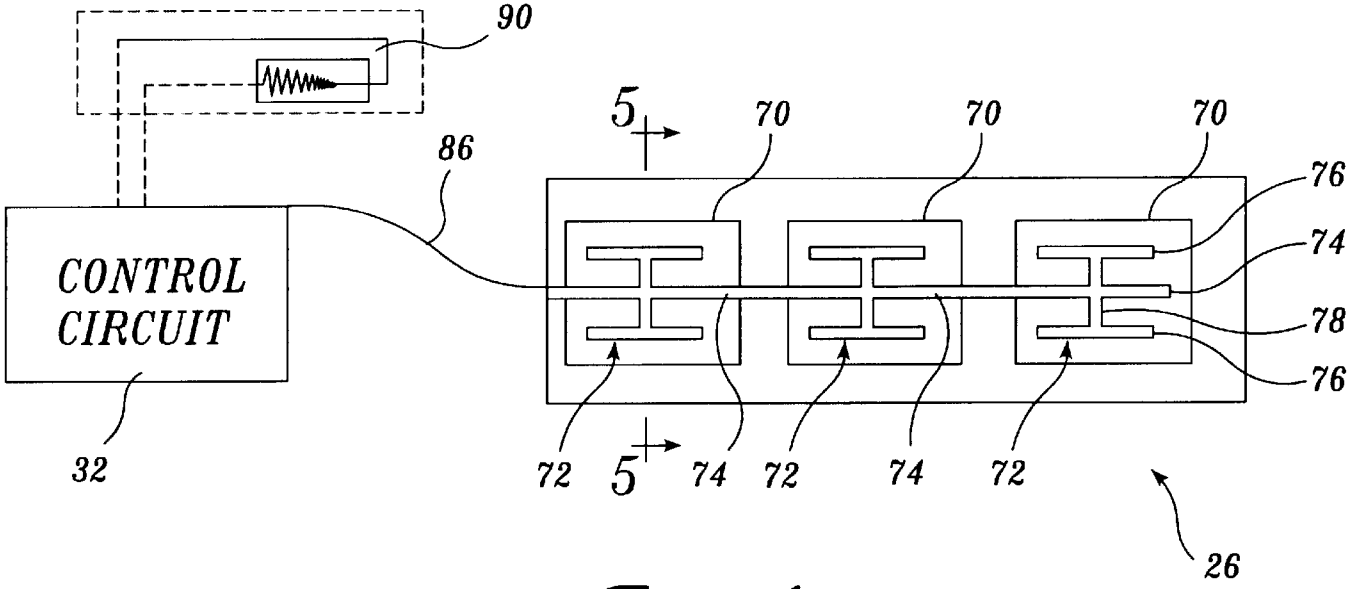
FIG. 4 is a top plan, partially schematic view of a piezoelectric damping system according to the present invention.
Figure 5:
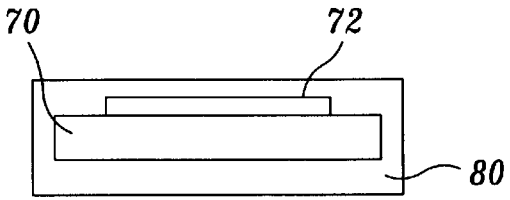
FIG. 5 is a cross section of the piezoelectric damper of FIG. 4 taken at line 5—5 in FIG. 4.

In the first embodiment, the piezoelectric damper 26 is formed of one or more rectangular pieces of piezoelectric lead zirconate titanate material 70 (FIGS. 4–5). Each piezoelectric material 70 is placed in line with the other pieces and spaced slightly longitudinally apart as illustrated in FIG. 4. An electrical circuit grid 72 is then placed and secured on the upper surface of the piezoelectric material 70 by adhesive bonding or other methods known in the art. In the first embodiment, each electrical grid 72 includes a central elongate electrode 74 and two side parallel elongate electrodes 76. The central electrode 74 extends approximately along the central axis of each piece of piezoelectric material 70. The side electrodes 76 are spaced slightly outward from the opposing sides of the central electrode 74 and extend parallel to the central electrode. The side electrodes 76 are electrically connected to the central electrode 74 by electrodes 78 that extend approximately perpendicularly between the central electrode 74 and side electrodes 76. The electrical grids 72 on each piece of material 70 are connected together by connecting the end extensions of the central electrode 74 together (FIG. 4) thereby forming a continuous electrical grid.

Although the first embodiment uses an electrical grid 72 as discussed above, other electrical configurations could also be used. It is advantageous that the electrical grids 72 define an electrical path that extends over a sufficient portion of the surface of the pieces of piezoelectric material 70 in order to optimize the efficiency of the electrical connection between the electrical grids 72 and the material 70.

Once the electrical grids 72 are joined to the pieces of material 70 the resulting joined structure is encapsulated in a protective polymer resin 80. The resin 80 joins the individual pieces of material 70 and electric grids 72 into a unitary piezoelectric damper 26. The resin 80 protects the pieces of material 70 from damage, ensures that the electrical grids remain in contact with the pieces of material 70, and also serves as a shear interface to transfer loads and vibrations between the structure of the ski and the pieces of material 70.

The resin 80 may be an epoxy resin, a bismolyimide resin, or other suitable resins or plastic materials capable of encapsulating and protecting the structure of the piezoelectric damper. The resin 80 should be durable and flexible enough to withstand the temperature variations, deflections and vibrations that a skier experiences during use. In the first embodiment, a bismolyimide resin sold under the trademark KYPTON™ is used.

The free end of the electrical grids 72 is electrically attached to a control circuit 32 by an electrical cable is 86. The control circuit 32 may be used to operate the piezoelectric damper 26 in either an "active" or a "passive" configuration in order to reduce resonant vibrations within the body of the ski. As described in more detail below, in a passive configuration the damping system 14 absorbs or dissipates the mechanical energy of the vibration, thus damping the vibration. In an active configuration, an electrical signal is provided to the piezoelectric damper 26 in order to deform the piezoelectric damper and thus provide a force opposing deformations in the body of the ski.

To configure the damping system 14 in a passive configuration, the control circuit 32 absorbs or dissipates the electrical current produced by the deformation of the piezoelectric material 70, thus dissipating the mechanical energy of the vibration. In its simplest embodiment, the control circuit 32 is a resistor that is electrically connected to the electric grids 72 to dissipate electricity produced by the piezoelectric material 20 by converting the electricity into heat. Using a resistor produces a piezoelectric damping system 14 that has broad band damping effects over the entire range of frequencies.

In alternate embodiments of the invention, the damping system 14 can be tailored to provide damping only at the resonant frequencies of the ski thus not affecting the performance of the ski due to nonvibration-related displacements. One such embodiment of the invention includes a sensor 90 (shown in phantom in FIG. 4). The sensor 90 is mounted on the top of the ski or within the ski such that it deforms as the ski deforms in response to deformations or vibrations. The sensor 90 can be a strain gauge, a piece of piezoelectric material, or any other type of sensor capable of providing a signal indicative of deformations within the ski to the control circuit 32.

The control circuit 32 includes a timing circuit that receives the signal indicative of deformations within the ski from the sensor 90, and produces a signal indicative of the frequency at which the ski is vibrating. Using the signal indicative of the frequency at which the ski is vibrating, the control circuit 32 selectively places a resistance on the flow of electricity from the piezoelectric damper 26 to provide damping only at preselected resonant vibration frequencies. Electrical circuits such as a timing circuit described above are readily known and understood by one of ordinary skill in the electrical control art.

In operation, as the ski 10 deforms during a vibration, the electrical current produced by the piezoelectric damper 26 passes through the cable 86 to the control circuit 32. The control circuit 32 provides a resistance to the flow of electricity from the piezoelectric damper 26 and thus dissipates the energy as heat. This resistance to the flow of current from the piezoelectric damper 26 also causes the piezoelectric damper to resist further deformation. The greater the deformation of the piezoelectric damper 26, the greater the electrical current produced, the greater the resistance provided by the control circuit, and thus the greater resistance to deformation by the damping system 14.

In alternate embodiments of the invention, the control circuit 32 can include a variable resistor. The resistance provided by the variable resistor can be altered by the skier in order to set the amount of damping provided by the piezoelectric damper to a desired value.

Figure 6:
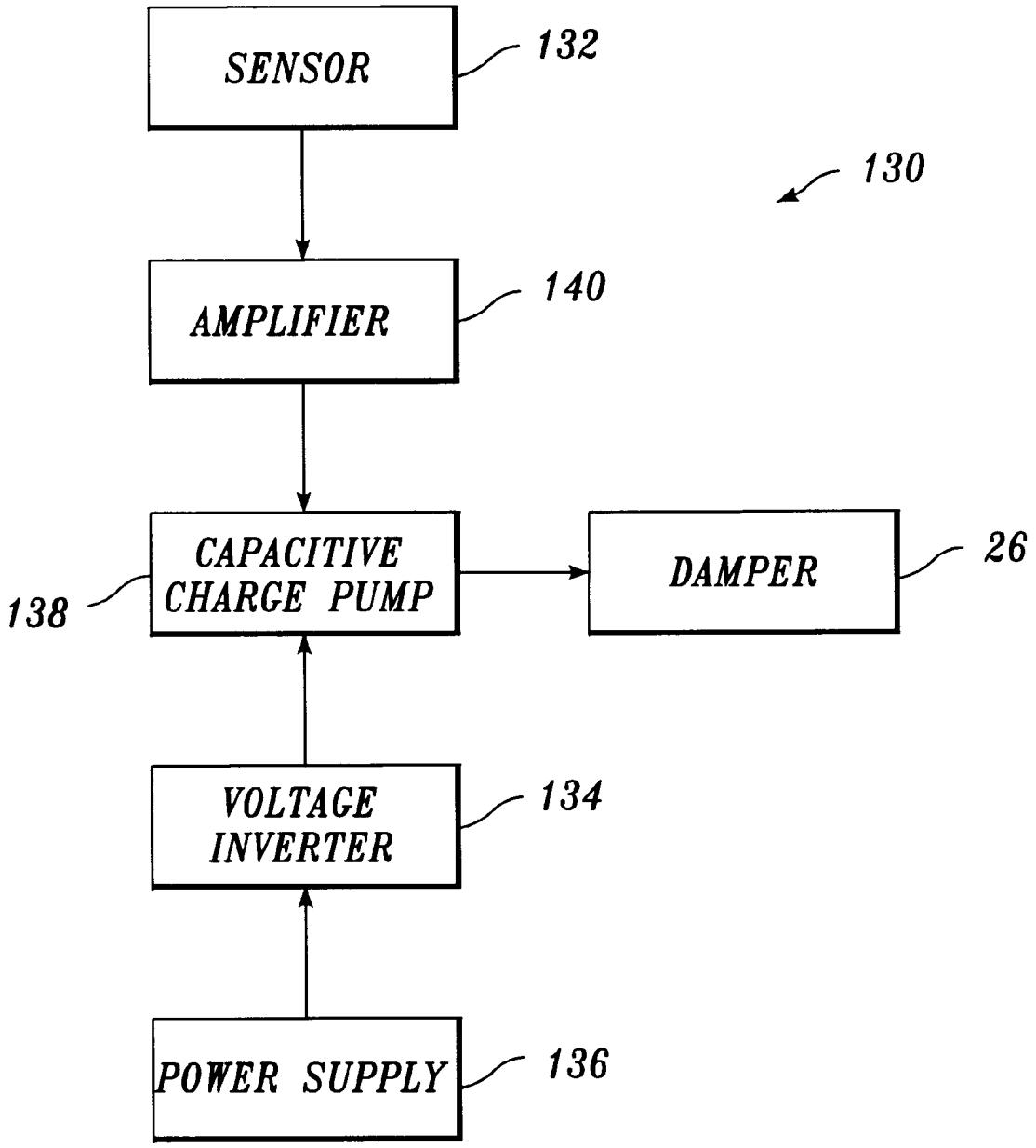
FIG. 6 is a schematic diagram of an embodiment of a control circuit for operating a piezoelectric damper according to the present invention.
Figure 7:
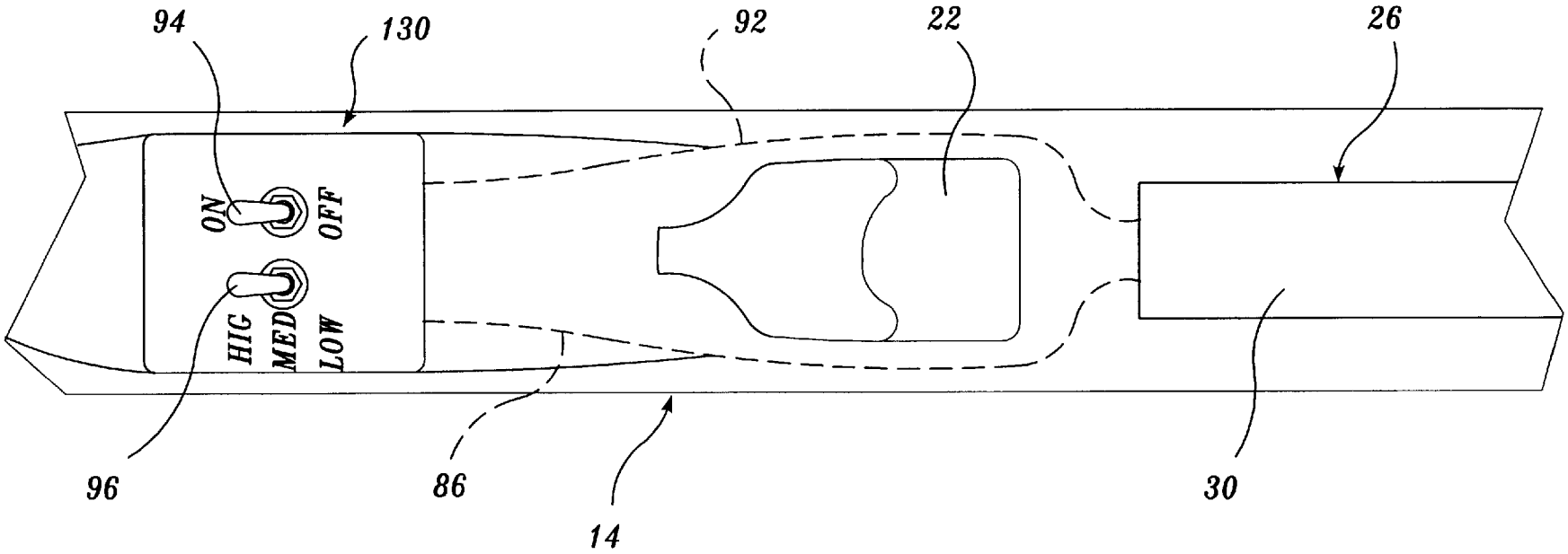
FIG. 7 is an enlarged top plan view of a portion of a second embodiment of a ski including a piezoelectric damper according to the present invention.

FIGS. 6 and 7 illustrate a second embodiment of the invention including an active piezoelectric damping system. In an active damping system, the same piezoelectric damper 26 may be used as the piezoelectric damper used in the passive configuration discussed above. However, in an active damping system, the function and operation of the control circuit 32 differs. In an active configuration, the control circuit 130 provides an electrical signal to the piezoelectric damper 26. The electrical signal causes the piezoelectric damper 26 to deform or resist deformation in such a way as to dampen vibrations within the ski. In a manner similar to that described above with respect to the passive configuration, the control circuit 130 may be configured to cause the piezoelectric damper 26 to selectively dampen predetermined resonant frequencies of the ski or to act as a broad band damper.

In the second embodiment, the control circuit 130 includes a sensor 132 (FIG. 6), an amplifier 140, a power supply 136, a voltage inverter 134 and a capacitive charge pump 138. The sensor 132 operates in a manner similar to the sensor 90 of the passive configuration described above. The sensor 132 can be a strain gauge, a piece of piezoelectric material, or any other type of sensor capable of providing a signal indicative of deformations in the body of the ski. In the preferred embodiment, the sensor 132 is a piece of piezoelectric material that produces a signal indicative of the frequency and amplitude of deflections within the body of the ski.

The sensor 132 can be located at various locations along the top surface of or throughout the thickness of the body of the ski. However, it is preferred that the sensor be located near the top surface of the ski, just below the cap so that the sensor 132 is located at an area of maximum strain produced during deformation of the ski.

As the body of the ski flexes or deforms, the sensor 132 produces a signal indicative of the ski's deformation. This signal is passed to and amplified by the amplifier 140. The amplified signal is used to trigger a capacitive charge pump 138. The capacitive charge pump 138 is electrically charged by an electrical current from the power supply 136. The electrical current is first passed through a voltage inverter 134 to obtain the desired voltages. When the capacitive charge pump 138 receives a signal from the sensor 132 indicative of a deformation in the ski, it provides an electrical control signal to the damper 26. This control signal energizes the damper 26 causing the damper to resist deformation within the ski. As deflections of greater magnitude are detected by the sensor 132, a control signal of greater magnitude is provided to the piezoelectric damper 26, thus increasing the damper's resistance to deflections within the body of the ski.

As illustrated in FIG. 7, the control circuit 130 is housed within a structural buildup 90 on the upper surface of the ski slightly forward of the toe binding 22. The control circuit 130 is connected to the piezoelectric damper 26 through the use of cables 86. The cables 86 extend from the control circuit 130 around the periphery of the toe binding 22 to the damper 26. In the preferred embodiment, the control circuit 130 includes an on/off switch 94 and a variable damping switch 96. The control circuit 130 is turned on or off by the skier through the use of the on/off switch 94. The skier may also adjust the amount of damping provided by the piezoelectric damper 26 by adjusting the damping switch 26 to a high, medium or low setting. The high, medium or low settings determine the magnitude of the voltage provided by the voltage inverter 134. The damping switch 26 thus adjusts the magnitude of the control signal provided to the piezoelectric damper 26 by the capacitive charge pump 138. The high, medium or low settings thus allow the skier to adjust the amount of damping provided by the piezoelectric damper 26.

In the second embodiment, the power supply is a 9-volt battery due to its small size and large energy storage capacity. The 9-volt battery is connected to the voltage inverter 134 to produce a voltage of 9, 18, or 36 volts, depending on the amount of damping selected using damping switch 96. In the second embodiment, a capacitive charge pump 138 is used due to its relatively small size and weight, and its relative immunity to the effects of vibration, temperature and humidity. However, in alternate embodiments of the invention, other control circuit designs could be used without departing from the scope of the invention. As well known by those of ordinary skill in the electrical control art, many different circuit layouts and designs can be used to produce similar results to those discussed above.

In the second embodiment, the control circuit 130 provides broad band damping over the entire frequency spectrum. However, in a similar manner to that described above with respect to the passive damper, alternate embodiments of the active damper could provide damping only at selected resonant frequencies of the ski. Such embodiments of the invention would include circuitry within the control circuit to detect the occurrence of resonant vibrations within the ski and then provide a control signal to the piezoelectric damper to dampen only the resonant vibrations.

As will be recognized by one of ordinary skill in the art, there are numerous different methods and electrical circuit designs capable of measuring the frequency of a vibration and of providing a responsive signal of the correct phase, frequency and amplitude to counteract the vibrations. One such method is disclosed in U.S. Pat. No. 4,565,940 (Hubbard, Jr.), which is specifically incorporated herein by reference. The control circuit 130 is just one example according to the present invention and is not meant to be limiting.

As illustrated in FIG. 2, it has been found advantageous to place the piezoelectric damper 26 between the toe and heel bindings 22 and 24. Generally, as illustrated by FIGS. 1A–E, one of the nodal points for each of the first four resonant frequencies of a ski occur between the toe and heel bindings. Therefore, placing the piezoelectric damper 26 between the toe and heel bindings allows the piezoelectric damper to efficiently dampen vibrations at the resonant frequencies.

As illustrated in FIG. 8, in other embodiments of the invention, piezoelectric dampers 100 and 102 can be placed at other locations, including in front of the toe binding 22 or behind the heel binding 24. Placing piezoelectric dampers 100 and 102 both in front of the toe binding 22 and behind the heel binding 24 is advantageous in some applications to ensure that vibrations are equally damped throughout the length of the ski.

In yet other embodiments, it can be advantageous to place a piezoelectric damper in front of, behind and in-between the toe and heel bindings 22 and 24. In still other embodiments, a film piezoelectric damper could be placed along the entire length of the ski thus producing a continuous damper.

FIG. 8 illustrates a ski 10 including both forward and aft piezoelectric dampers 100 and 102. The ski 108 also includes a binding isolation plate 108. The binding isolation plate 108 is separated from the body 110 of the ski by a viscoelastic layer 112. An exemplary embodiment of such a ski is described in U.S. Pat. No. 5,232,241 (Knott et al.), which is specifically incorporated by reference. The purpose of the binding isolation plate 108 and viscoelastic layer 112 is to isolate the bindings 104 and 106 and user's boot from the rest of the ski. Thus, the binding isolation plate helps to isolate the user from vibrations within the body of the ski.

If a piezoelectric damper is placed on the binding isolation plate 108, it will be less effective due to the isolating effect of the viscoelastic layer 112 than if it were placed at other locations on the ski. However, the isolating effect of the viscoelastic layer 112 will not prevent the piezoelectric damper from helping to dampen vibrations within the ski.

In alternate embodiments of the invention, the piezoelectric damper 26 could be oriented either perpendicularly across the width of the ski or obliquely between the sides of the ski in order to dampen torsional vibrations. In such applications, the control circuit and piezoelectric damper would operate in a similar manner to that described above with respect to longitudinally oriented dampers.

In yet other embodiments of the invention, piezoelectric dampers according to the present invention could be used on snowboards. Snowboards are generally constructed in a manner similar to skis and undergo similar resonant vibrations during use.

Figure 9:
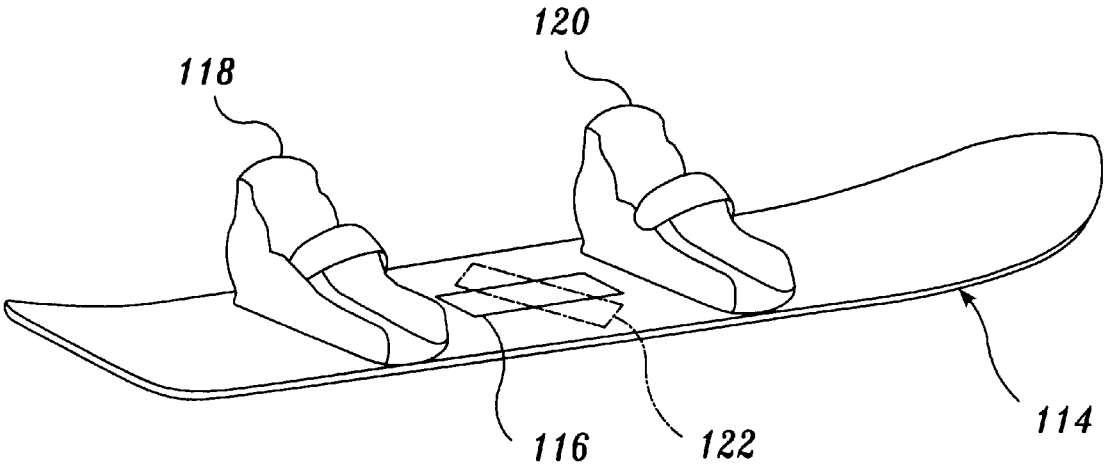
FIG. 9 is an embodiment of a snowboard including a piezoelectric damper according to the present invention.

FIG. 9 illustrates a snowboard 114 incorporating a piezoelectric damper 116 according to the present invention. The piezoelectric damper 116 extends longitudinally at least part of the way between the forward and aft bindings 118 and 120, respectively. The piezoelectric damper 116 functions in a similar manner to that described with respect to the piezoelectric dampers on the ski embodiments of the present invention described above, and may be understood by reference thereto. In alternate embodiments of the invention, the piezoelectric damper 116 may be located in front of or behind the forward and aft bindings 118 and 120.

In a manner similar to that described above with respect to skis, a piezoelectric damper 122 (shown in phantom in FIG. 9) may be oriented at an angle with respect to the longitudinal axis of the snowboard. In such configurations, the piezoelectric damper 122 can be used to dampen torsional vibrations or to change the torsional characteristics of the snowboard.

In a manner similar to that described above with respect to ski embodiments of the invention, piezoelectric dampers on snowboards may be either active or passive dampers. Also, in a manner similar to that described above with respect to skis, passive or active embodiments of piezoelectric dampers according to the present invention could either be broad band dampers or could dampen vibrations occurring only at the snowboard's resonant frequency.

Figure 10:
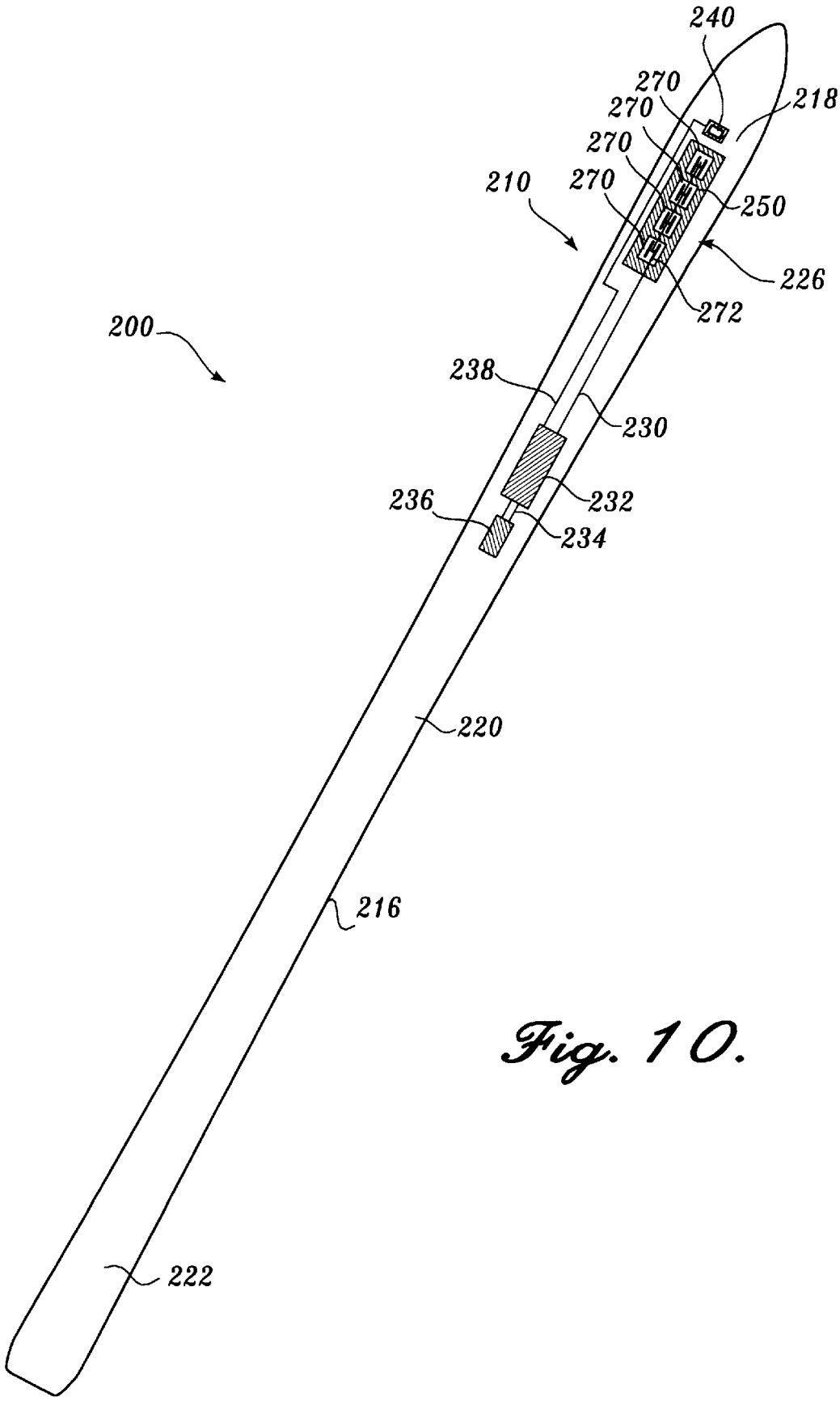
FIG. 10 is a top plan view of a further embodiment of a ski including an active damping system shown schematically therewith.

FIG. 10 illustrates another embodiment of a ski 200 including a piezoelectric damping system 210. The ski 200 and piezoelectric damping system 210 is constructed similarly to that previously described for the ski of FIGS. 2 and 5 and the active piezoelectric damping system of FIGS. 6 and 7, except as noted. Thus points in common are not described in great detail. It is also to be understood that previously described alternatives and variations to the earlier embodiments apply as well to the embodiment of FIG. 10. The ski 200 of FIG. 10 includes a body 216 including a forward shovel portion 218, a narrow waist portion 220, and a tail portion 222. Conventional toe and heel bindings (not shown) are mounted on the ski forward and rearward of the waist portion 220, as is well-known in the art.

The piezoelectric damping system 210 includes a piezoelectric damper 226. The piezoelectric damper 226 is constructed identically to the previously described piezoelectric damper 26 of FIG. 4, except that the piezoelectric damper 226 is illustrated as incorporating four pieces of piezoelectric material 270. However, the exact number of pieces of piezoelectric material 270 or the number of layers of piezoelectric material that are secured together, may be varied as desired for a predetermined degree of damping. The pieces of piezoelectric material 270 are arranged in a linear series along the longitudinal axis of the ski body 216.

The piezoelectric pieces 270 are suitably mounted above a fiber reinforcement layer within a recess 250 defined in the upper surface of the core of the ski. Alternately, a stress concentrating plate, such as a metallic plate (not shown), may be received within the recess 250 and the piezoelectric material pieces 270 mounted thereon. The piezoelectric pieces 270 are electrically connected together by an electrical circuit grid 272, including a central elongate electrode, side parallel elongate electrodes, and connecting electrodes, arranged the same as for the previously described electrical circuit grid 72 of FIG. 4. The piezoelectric damper 226 is encapsulated between the fiber-reinforced layers surrounding the core and the protective top cap of the ski body 216, as previously described, and is encapsulated by a resin infusing the voids therebetween.

As described for previous embodiments, the electrical circuit grid 272 is connected by an electrical lead 230 to a control circuit 232. The control circuit 232 is in turn connected by first and second electrical leads 234 to a power supply 236, such as a 9-volt battery. The control circuit 232 is also connected by an electrical lead 238 to a vibration sensor 240, such as a strain gauge or a second piece of piezoelectric material, as previously described.

As in the previously described embodiment of FIG. 7, the control circuit 232 and power supply 236 are preferably mounted on the top surface of the ski body 216 just forward of the toe binding, within a structural buildup beneath the upper cap of the ski body 216. The placement of the control circuit 232 and power supply 234 at just forward of the mid-sole location, just forward of the toe binding, is important because of weight dampening effects. The piezoelectric damper 226 may be mounted at any location along the ski, and preferably at one of the nodal points of the four resonant frequencies of the ski. Thus, the piezoelectric damper 226 may be mounted rearwardly of the heel binding, between the toe and heel bindings, or forwardly of the toe binding within the shovel portion 18. The piezoelectric damper 226 may be mounted either longitudinally, obliquely or perpendicularly to the longitudinal axis of the ski body 216.

In the preferred embodiment of FIG. 10, the piezoelectric damper 226 is mounted longitudinally along the axis of the ski body 216, forwardly of the toe binding within the shovel portion 218 of the ski body 216. Preferably, the piezoelectric damper 226 is centered about the forwardmost nodal point for one of the resonant frequencies of the ski. The sensor 240 is suitably mounted just forwardly of the piezoelectric damper 226, also beneath the top cap of the ski body 216.

Figure 11:
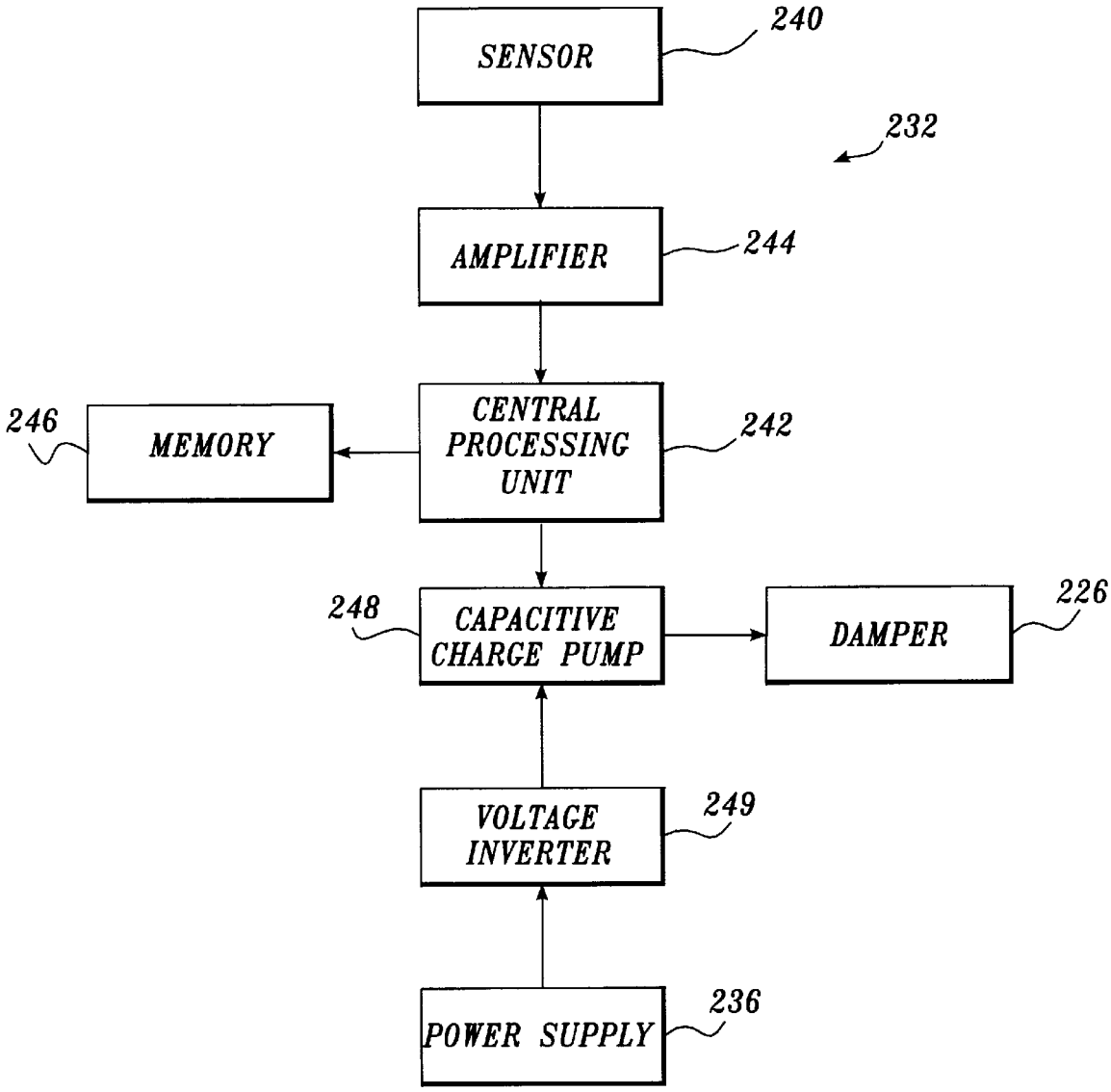
FIG. 11 is a schematic diagram of the damping system of FIG. 10.

Attention is now directed to FIG. 11 for a description of the control circuit 232. The control circuit 232 is shown interconnected with the sensor 240, damper 226 and power supply 236. The control circuit 232 includes a central processing unit 242, an amplifier 244, a memory storage device 246, a capacitive charge pump 248 and a voltage inverter 249. As in the previously described embodiment of FIG. 6, the active control circuit 232 provides an electrical signal to the piezoelectric damper 226, causing the damper 226 to deform or resist deformation in such a way as to dampen vibrations within the ski. However, unlike the configuration of FIG. 6, the control circuit 232 of FIG. 11 provides for generation of a control electrical signal that is proportional to both the amplitude and the frequency of the sensed vibration within the ski body but has an inverse waveform. The control circuit tree 232 also provides for sensing, recordation and subsequent downloading of signals measured during usage of the ski.

Referring again to FIG. 11, the sensor 240 produces an electrical signal indicative of the frequency and amplitude of deflections within the body 216 of the ski 200 at the point of placement of the damper 226 and sensor 240. As noted above, the sensor 240 may suitably be a piece of piezoelectric electric material, or another sensor capable of providing a signal indicative of deformations in the body of the ski, such as a strain gauge. The signal from the sensor 240 is passed to an amplifier 244. The signal from the amplifier 244 in turn is passed to a central processing unit 242. This received signal from the amplifier 244 may be stored in a memory device 246, such as a random access memory chip. The central processing unit 242 contains logic to relate the signal received from the amplifier 244 to the actual frequency and magnitude of the vibration.

In the preferred embodiment, the central processing unit 242 compares the sensed signal from the amplifier 244 using a control algorithm operating routine, and generates an inverse wave signal of the same frequency and of the same or proportional amplitude to the capacitive charge pump 248. The capacitive charge pump 248 receives power from the power supply 236 via the voltage inverter 249. The capacitive charge pump 248 thus generates an inverse waveform control signal, having the same frequency and an amplitude proportional to the amplitude of the signal from the sensor 240, that is supplied to the damper 226 to energize the damper 226. The damper 226 is thus activated, in a time variant cyclic fashion to resist deformation in a manner which partially or completely cancels out the vibrational frequency of the ski body 216, thereby reducing or eliminating the resonant vibration. Because of the speed of operation of the central processing unit 242 and associated circuitry, this alternating or cyclic damping occurs substantially instantaneously. The level of damping, both in amplitude and frequency, is proportional to the sensed vibration.

The storage of the sensed signal 240 in the memory device 246 enables the monitoring, recordation and temporary storage of ski usage parameters, such as the duration of skiing on snow, the speeds attained by the skier during usage of the ski 200, time period spent on a lift chair, and the time period spent in certain types of terrain, such as moguls. This stored data from memory 246 can then be downloaded after skiing, through a conventional electronic communication port mounted in the ski body, or an infrared, radio or ultrasonic transmission, to a laptop computer or other computer device. This data thus provides a skier profile that can be downloaded and analyzed after skiing. While described herein as incorporated into an active control circuit, this data recordation and storage system can also be adapted for use with a passive damping system.

As in previously described embodiments, the control circuit 232 can be provided with user inputs to adjust the level of dampening provided, such as a pot rotated with a screwdriver. Additionally, the control circuit tree 232 can include logic to permit selective adjustment of the: ski shape, i.e., camberline for better edge grip in differing snow conditions; specific selected frequencies that are being damped for desired applications; or to change the shape of the ski to correct mistakes made by the skier. Logic for such adjustment may be preprogrammed into the central processing unit, or may be downloaded into the central processing unit 242 by the skier.

The damping system 210 of the embodiment of FIG. 10 can be used at various locations along the length of the ski body 216. The forebody and aft body of the ski vibrate independently. However, it has been found that most of the vibrations occur in the forebody at frequencies between approximately 15 Hertz and 30 Hertz. On hard snow, the coupling of longitudinal and torsional vibrations at 90 Hertz to 120 Hertz effects the skis' forebody as well. Vibrations in the aft body are smaller and take place over a wider range of frequencies from 20 to 120 Hertz. Thus, while the damping system 214 can be disposed at various locations along the length of the ski body 216, mounting within the forebody, i.e., the shovel portion 18, is most effective. As for previously described embodiments, the damping system 214 is also well suited for use in snowboards, and can be mounted longitudinally, transversely or obliquely.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A board for use on snow, comprising:

(a) a longitudinally extending structural, flexing body;

(b) a sensor coupled to the body so as to flex with the body to produce a sensed electrical signal in response to a vibration produced within the body;

(c) a control circuit mounted on the body and electrically connected to the sensor that receives the sensed electrical signal and generates an electrical control signal in response thereto, the control signal having a waveform that is an inverse of the sensed electrical signal and that is proportional to the amplitude and to the frequency of the sensed electrical signal;

(d) a piezoelectric material coupled to the body so as to flex when the body flexes, the piezoelectric material being electrically connected to the control circuit so that electrically induced deformation of the piezoelectric material is influenced in response to the control signal to dampen vibrations within the body; and (e) a power supply electrically connected to the control circuit.

2. A The board of claim 1, wherein the sensor comprises a second piezoelectric material.

3. The board of claim 1, wherein the control circuit generates a control signal for damping only predetermined frequencies of the sensed electrical signal.

4. The board of claim 1, wherein the body comprises a ski, and the piezoelectric material is mounted on a shovel portion of the ski.

5. The board of claim 1, wherein the body comprises a snow board.

6. The board of claim 1, wherein the body comprises a core, the core defining a recess and the piezoelectric material being received within the recess of the core.

7. The board of claim 1, wherein the body comprises a core reinforced with a structural reinforcement layer, wherein the piezoelectric material is mounted on the structural reinforcement layer.

8. The board of claim 1, wherein the body comprises a top cap, a bottom cap, a core disposed between the top and bottom caps, and a structural reinforcement layer reinforcing the core, wherein the piezoelectric material is mounted between the structural reinforcement layer and the top cap.

9. The board of claim 1, wherein the piezoelectric material is oriented along a longitudinal axis of the body.

10. The board of claim 1, wherein the piezoelectric material is oriented obliquely to a longitudinal axis of the body.

11. The board of claim 1, further comprising a memory device included within the control circuit, the memory device storing data corresponding to the sensed electrical signal.

12. The board of claim 4, wherein the control circuit is mounted immediately forwardly of a toe binding region of the body.

13. The board of claim 7, wherein the structural reinforcement layer defines a torsion box, the piezoelectric material being mounted on the torsion box.

14. The board of claim 11, wherein the stored data is indicative of the duration of time in which the board traverses the snow.

15. The board of claim 11, wherein the data stored is indicative of the vibrational frequencies to which the board is exposed during use on snow.

16. A board for use on snow, the board comprising:

(a) a longitudinally extending structural, flexing body;

(b) a sensor coupled to the body so as to flex when the body flexes to produce a sensed electrical signal in response to a vibration produced within the body;

(c) a control circuit electrically connected to the sensor that receives and regulates the sensed electrical signal;

(d) a memory device electrically connected to the control circuit for receiving and storing data indicative of the sensed electrical signal; and (e) a piezoelectric material connected to the body so as to flex when the body flexes and electrically connected to the control circuit to influence the deformation of the piezoelectric material in response to the sensed electrical signal to dampen vibrations within the body.

17. The board of claim 16, further comprising a power supply electrically connected to the control circuit.

18. The board of claim 16, wherein the data stored by the memory device is indicative of the vibrational frequencies produced within the body.

19. The board of claim 16, wherein the data stored by the memory device is indicative of the duration of time of use of the board on the snow.

* * * * *